US005358129A

United States Patent [19]

Watts

[11] Patent Number: 5,358,129

[45] Date of Patent: Oct. 25, 1994

[54] CHILD RESISTANT BOTTLE

[75] Inventor: Colin F. Watts, Yardley, Pa.

[73] Assignee: McNeil-PPC, Inc., Milltown, N.J.

[21] Appl. No.: 82,132

[22] Filed: Jun. 24, 1993

[51] Int. Cl.[5] ..... B65D 55/02

[52] U.S. Cl. ..... 215/206; 215/223; 215/224; 215/305

[58] Field of Search ..... 215/206, 223, 224, 225, 215/305; 220/212.5

[56] References Cited

U.S. PATENT DOCUMENTS 4,375,859 3/1983 Fillmore ..... 215/223

5,213,225 5/1993 King et al. ..... 215/330

*Primary Examiner*—Allan N. Shoap

*Assistant Examiner*—Nova Stucker

*Attorney, Agent, or Firm*—Paul A. Coletti

[57] ABSTRACT

An easy open container which is also child resistant provides for a cap for attachment to the container. The cap contains an indent for retaining the cap on the base. On the neck of the container there is contained a lip which retains the indent thereon so that the cap is child resistant. In addition, the cap is also easy to open in that extending from the cover portion of the cap is a flange, which provides for an easy to grip mechanism so that an arthritic user is able to grip the cap and align the detent with a discontinuity in the lip.

11 Claims, 1 Drawing Sheet

CHILD RESISTANT BOTTLE

FIELD OF THE INVENTION

Generally this invention relates to a child resistant bottle for providing analgesic tablets to consumers. More specifically, this invention relates to providing an easy open bottle which is also child resistant, thereby allowing arthritic users to readily open the bottle, yet retaining its easy-to-open and yet child resistant capabilities in order to prevent children from opening the container inadvertently.

BACKGROUND OF THE INVENTION

Containers having closures are well known and have a wide variety of uses. For example, they may contain medicines or pharmaceuticals. They may contain drinks, such as carbonated or non-carbonated water, colas and the like, or wines or spirits (e.g. gin or whiskey). Again they may contain petrol, oil, or household preparations or chemicals such as hair care products, detergents, bleaches and the like. The present invention is applicable to all of these areas of use and many others besides.

The conventional containers mostly have simple screw closures, which suffer from various disadvantages. For example, the closures are difficult for elderly or infirm people to operate because quite a significant torque is required and because the closure needs to be turned through more than one revolution relative to the container either to remove the closure or to replace it.

If the container is a drink container, it may be difficult for the user to seal it satisfactorily. On the one hand, the user may under-tighten the closure on the container (and thus not create an effective seal between container and closure), in which case the drink would not retain its original quality. A soft drink or still wine would not stay fresh; a carbonated beverage, sparkling wine or champagne would lose its frizziness, and spirits would evaporate. On the other hand, if the user overtightened the closure, the closure would be difficult to unscrew again.

A similar sealing problem also arises with containers for other liquids. If the user under-tightened the closure, the liquid might evaporate (e.g. gasoline), give off odorous or harmful vapors (e.g. oil or certain hazardous chemicals), or become contaminated. Again, if the user over-tightened the closure, the closure would be difficult to unscrew.

According to one aspect of the King et al., U.S. Pat. No. 5,213,225 there is provided a container neck and a container closure comprising a first thread on one of the neck and the closure, a complementary second thread on the other of the neck and the closure such that the closure is moveable from fully disengaged from the neck to fully closed by turning the closure relative to the neck by less than 360°, at least one stop formation carried by said one of the neck and the closure, and stop means on said other of the neck and the closure engageable with the stop formation or at least one of the stop formations to hold the closure in a closed position on the neck, the arrangement of the or each stop formation, the stop means and the threads being such that the stop means is rotated past the stop formation or at least one of the stop formations without engagement therewith when the closure is screwed on to the neck, engagement of the stop means with the stop formation or at least one of the stop formations commencing only when the closed position is neared.

However, it is perceived that even a container such as that described by King has a certain disadvantage to arthritic users in general. That is, the King patent is not child resistant. Child resistant containers are essential when dispensing analgesics or other pharmaceuticals. In this regard, while the King reference discloses a device which is easy to open, it suffers from the limitation that one must take precautionary safeguards, in order to avoid leaving this container within the grasp of children who are also similarly likely to be able to open the container.

SUMMARY OF THE INVENTION

In that regard the present invention provides for an easy open container which also deals with the deficiencies which are encountered with other easy open containers. That is, this easy open container is also child resistant. It provides for a container with a base and a neck extending from the base. Tablets such as analgesics and other pharmaceuticals can be held within the base. There is contained a cap for attachment to the container. The cap itself contains detent means for retaining the cap on the base. The detent means is generally a indent disposed on the interior cylindrical wall of the cap. Furthermore, on the neck of the container there is contained a lip which retains the indent thereon after the indent has been disposed over the lip. Thus, the cap is child resistant in a familiar way, in that it requires the user to line the indent with this discontinuity on the lip in order to be able to remove the cap readily from the container. However, in addition to being child resistant the cap is also easy to open, in that extending from the cover portion of the cap is a flange. This flange provides for an easy to grip mechanism so that an arthritic user is able to grip the cap and align the detent with the discontinuity in the lip so that opening the cap is thereby facilitated.

Other objects of the invention will be immediately apparent when reading the Detailed Description of the Invention in conjunction with the attached drawings in which:

DETAILED DESCRIPTION OF THE INVENTION

Figure 1:
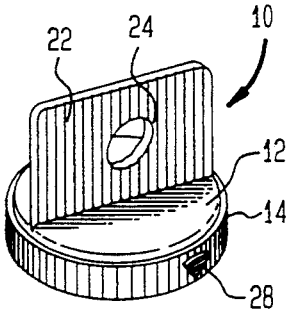
FIG. 1 is a perspective view of the exterior portion of the cap containing an easy open grip means extending therefrom.
Figure 2:
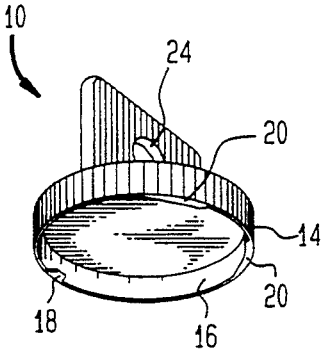
FIG. 2 is a perspective view of the underside of the part of the cap containing a indent mechanism which provides for a child resistant protection.
Figure 3:
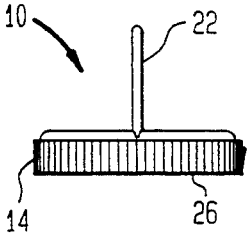
FIG. 3 is a side view of the cap and flange combination.

As seen in FIGS. 1–8 there is disclosed a cap and container combination 100 made from generally deformable plastic-like material which allows for child resistant protection as well as easy opening thereof. The cap 10 is better seen in FIGS. 1, 2, 3 and 6. The cap 10 generally contains a cover portion 12 which has a cylindrical wall 14 extending therefrom. This cylindrical wall 14 is generally hollow and contains on its interior side 16 a generally knob-like indent 18 which will form a portion of the retaining means which provides child resistant capabilities. Rims 20 furthermore help to hold cap 30 on the container. Extending from the cover 12 is a easy-to-grip flange 22. This flange 22 contains within it a circular opening 24 which provides for the insertion of a cylindrical tube such as a pen for those extremely arthritic users of the cap and container combination 100.

The flange 22 is generally disposed across a diameter of the cylindrical wall 14 of the cap 10. The indent 18 is generally placed at a portion midway across the length of the flange 22 along the interior 16 of the cylindrical wall 14. Thus, when the cap 10 is to be removed from the container 50, it is relatively easy to pry the cap 10 off of the neck portion 52 of the container 50 at the gripping flange 22. Or, the user may insert a pen into opening 24 and be able to similarly pry the cap at the flange 22 perpendicularly to a diameter running through indent 18, so that it is removed from the neck 52 of the container 50.

Figure 4:
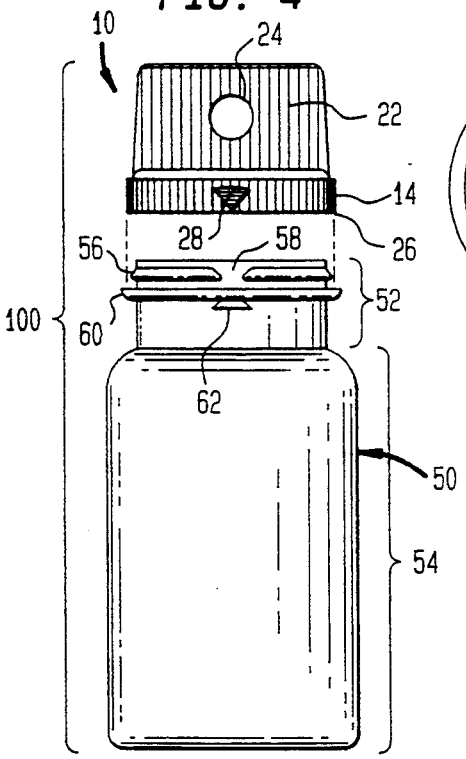
FIG. 4 is an elevation view of the cap such that the indent is aligned with the lip to provide opening or closure of the package.
Figure 5:
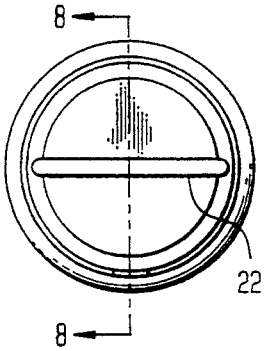
FIG. 5 is a top view of the cap attached to the container.

The container 50 is better seen in FIGS. 4, 5, 7 and 8. In general the container is a hollow cylinder 54 and contains a small hollow cylindrical neck 52 extending therefrom. On the neck portion 52 there is contained a lip 56 which provides mating detent means for cylindrically disposed indent 20 on the cap 10. Similarly, there is an abutting radially extending lower lip 60 which provides for a stop mechanism for the end 26 of the cylindrical wall 14 of the cap 10. This is best seen in FIG. 5.

Figure 6:
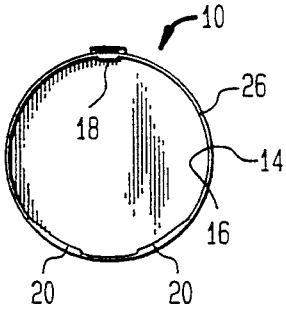
FIG. 6 is a bottom view of the cap.
Figure 7:
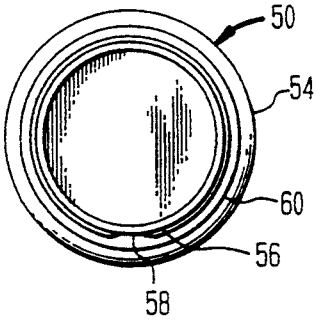
FIG. 7 is a top view of the container indicating the indent means.

The locking mechanism which allows the device to be child resistant is generally known in the art. That is, in order for the cap 10 to be locked onto the cylindrical neck 52, the detent 18 must be placed over the lip 56 so that the detent is difficult to pry from the device at any point other than at the discontinuity 58 seen in the lip in FIG. 4. Then, when the indent 18 as seen in FIG. 6 is aligned with the discontinuity as seen in FIG. 7 the cap 10 becomes very easy to pry from the container neck 52. However, the device proves very child resistant in that a child must align the indent 18 with the discontinuity 58 in the lip 56. While indication means 28, 62 are provided as seen in FIGS. 1 and 4, the child must know that these indication means 28, 62 indicate that the indent 18 is contained behind the indication means 28 and therefore is aligned on neck 52, as in FIG. 4. Unless the child knows that such an alignment must take place, it is quite difficult to remove the cap 10.

Figure 8:
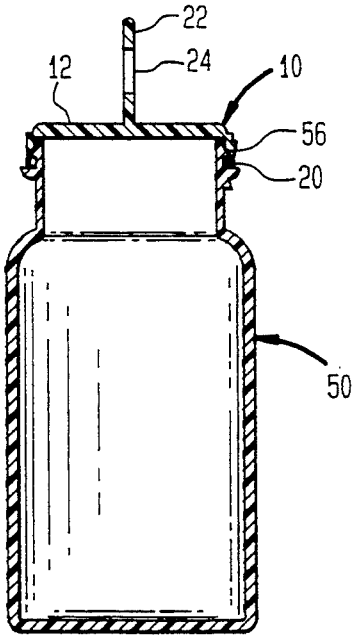
FIG. 8 is a cross-section of the cap disposed on the on the container taken across lines 8—8 of FIG. 5.

As best seen in FIG. 8, therefore, the indent 18 is displaced over the lip 52 so that it is difficult to remove from the cap 10 until alignment occurs, as best seen in FIG. 4. Thereafter, removal of the cap is quite easy, and is more readily facilitated due to the flange 22 contained on the cover portion 12 of the cap 10. As previously discussed above, this flange facilitates use by either by a prying mechanism such as a pen or makes gripping by hand easier. In either event, the device functions as an easy open, and yet child resistant container.

It is to be realized that the invention described herein is more readily ascertained by the attached claims and their equivalents.

I claim:

1. A child resistant package comprising:

a container having a base and a neck extending longitudinally therefrom;

a cap for attachment to said container, said cap having detent means for retaining said cap on said neck and said cap having a cover extending transversely to said neck with a hollow cylindrical wall extending therefrom, said detent means placed on said wall;

said neck including retention means for retaining said detent means on said neck, and release means which allow release of said detent means from said neck; and said cap including grip means comprising a flange extending longitudinally from said cover and said flange disposed on said cover across a diameter of said wall, and said detent means disposed on said wall perpendicular to a line extending from the midpoint of said flange.

2. The package of claim 1 wherein said flange contains a hole therein, said hole capable of accepting a cylindrical tube therein so as to facilitate pulling said cover off said neck.

3. The package of claim 1 wherein said neck is cylindrical and said retention means comprises a lip disposed about said cylindrical neck.

4. The package of claim 2 wherein said detent means comprises an indent disposed on said cylindrical wall.

5. The package of claim 4 wherein said cylindrical wall is deformable so as to allow said indent to be placed over said retention means, such that said indent is held on said neck by said lip.

6. The package of claim 4 wherein said lip contains a discontinuity therein, said discontinuity forming said release means, and said indent capable of sliding within said release means so as to allow said cap to be removed from said neck.

7. A child resistant package comprising:

a container having a base and a neck extending longitudinally therefrom;

a cap for attachment to said container, said cap having detent means for retaining said cap on said neck and said cap having a cover extending transversely to said neck;

said neck including retention means for retaining said detent means on said neck, and release means which allow release of said detent means from said neck;

said cap including grip means comprising a flange extending longitudinally from said cover;

wherein said cap has a hollow cylindrical wall extending from said cover and said detent means comprises a an indent disposed on said cylindrical wall; and wherein said flange is disposed on said cover across a diameter of said wall, and said indent is disposed on said wall perpendicular to a line extending from the midpoint of said flange.

8. The package of claim 7 wherein said flange contains a hole thereon, said hole capable of accepting a cylindrical tube therein so as to facilitate pulling said cover off said neck.

9. The package of claim 7 wherein said neck is cylindrical and said retention means comprises a lip disposed about said cylindrical neck.

10. The package of claim 9 wherein said cylindrical wall is deformable so as to allow said indent to be placed over said retention means, such that said indent is held on said neck by said lip.

11. The package of claim 9 wherein said lip contains a discontinuity therein, said discontinuity forming said release means, and said indent capable of sliding within said discontinuity so as to allow said cap to be removed from said neck.

* * * * *